US006601267B2

(12) United States Patent
Salice

(10) Patent No.: US 6,601,267 B2
(45) Date of Patent: Aug. 5, 2003

(54) HINGE FOR PIECES OF FURNITURE WITH DEVICE FOR THE SLOWED CLOSING OF THE DOOR

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 09/902,499

(22) Filed: Jul. 10, 2001

(65) Prior Publication Data

US 2002/0050025 A1 May 2, 2002

(30) Foreign Application Priority Data

Oct. 10, 2000 (IT) ..... MI2000565 U

(51) Int. Cl.[7] ..... E05D 3/06
(52) U.S. Cl. ..... 16/287
(58) Field of Search ..... 16/287, 288, 306, 16/281, 289, 236, 302, 361, 370, 352

(56) References Cited

U.S. PATENT DOCUMENTS 4,352,222 A * 10/1982 Mages et al. ..... 16/287
4,527,825 A * 7/1985 Clouse ..... 16/287
5,465,463 A * 11/1995 Lautenschlager ..... 16/236
6,205,619 B1 * 3/2001 Jang ..... 16/352
6,269,521 B1 * 8/2001 Gabel ..... 16/287

* cited by examiner

*Primary Examiner*—Robert E. Pezzuto
(74) *Attorney, Agent, or Firm*—Herbert Dubno

(57) ABSTRACT

A hinge, in particular for pieces of furniture, piece of furniture, with an arm fixable to the body of the connected to a portion of hinge that oscillates through two equalizers housed on transversal pins, of which—in the portion of one of its oscillation axes'—one equalizer has a projecting part forming a lever arm, and with an elastic member that stresses, the projecting part of the equalizer so as to cause a thrust in the closing direction on the oscillating hinge portion. In order to obtain the slowed closing of the door, one of the equalizers is provided with a second projecting part on which a second elastic member acts so as to exert a thrust that, for an oscillation portion close to the closed position of the oscillating hinge portion counteracts the thrust exerted by the first elastic member.

7 Claims, 3 Drawing Sheets

HINGE FOR PIECES OF FURNITURE WITH DEVICE FOR THE SLOWED CLOSING OF THE DOOR

FIELD OF THE INVENTION

The present invention relates to a hinge, in particular for pieces of furniture, with an arm which can be attached to the body of the piece of furniture, connected to a portion of hinge that oscillates through two equalizers housed on transversal pins, of which—in the portion of one of its oscillation axes—one equalizer has a projecting part forming a lever arm, and with an elastic member that stresses the projecting part of the equalizer so as to cause a thrust in a closing direction on the oscillating hinge portion.

BACKGROUND OF THE INVENTION

Closing devices applied to hinges for pieces of furniture are known, to which there are coupled deceleration systems for decreasing the door speed just before it reaches its closed position, so as to prevent irritating noise and shock.

DE 31 20 201 A1 discloses a hinge for pieces of furniture of this type, with a piston housed in the hinge arm, on which there slides a cylinder pulled by a lever integral with an equalizer and braked by a coating of its walls that increases its friction coefficient. Such known deceleration devices do not usually have a complex and high-precision structure, but they do take up much space in the hinge arm, thus making the arrangement of fixing and adjustment elements difficult.

OBJECT OF THE INVENTION

Thus, the object of the invention is to prove a hinge with a closing device of the type described above, which should have a not very expensive and bulky deceleration system.

SUMMARY OF THE INVENTION

According to the invention, this object is achieved by providing one of the equalizers with a second projecting part on which a second elastic member acts to exert a thrust that, for an oscillation portion close to the closed position of the oscillating portion of the hinge counteracts the thrust exerted by its first elastic member.

The use of a second elastic member that directly acts on an essential element of the hinge, like an equalizer avoids the need of having to use additional elements connected to such essential elements which effect the braking by interacting between themselves. This results in the use of fewer components thus allowing a saving in space.

The two projecting parts on which the two elastic members respectively act can be suitably arranged on the same equalizer.

I a preferred embodiment, the second projecting part consists of a cam obtained on the U-bent sides of the equalizer that is closer to the body of the piece of furniture, and it comprises a first portion that is concentric to the oscillation axis, which in the hinge closing direction is followed by a Portion at increasing distance up to an edge, beyond which the distance rapidly decreases.

Just before the closed position of the hinge, the elastic contrast member abuts against the decreasing distance portion just beyond the farthest edge from the oscillation axis, so as to exert a thrust in the closing direction that adds to the thrust exerted by the first elastic member.

The second elastic contrast member can suitably consist of a torsion spring housed on a transversal pin in the hinge arm, with a fixed shank abutting against the back of the hinge arm and the other shank acting upon the equalizer cam.

A further embodiment provides for the torsion spring to have a symmetrical shape, with the fixed shank consisting of two central shanks connected to one another by slot and with two side shanks that abut against the equalizer cams.

The fixed shank of the elastic member can abut against the lower portion of a screw screwed into the back of the hinge arm, which allows adjusting its pre-compression force and thus, the exerted contrast force.

BRIEF DESCRIPTION OF THE DRAWING

Embodiments of the invention are shown below with reference to the drawing. In the drawing.

SPECIFIC DESCRIPTION

Figure 1:
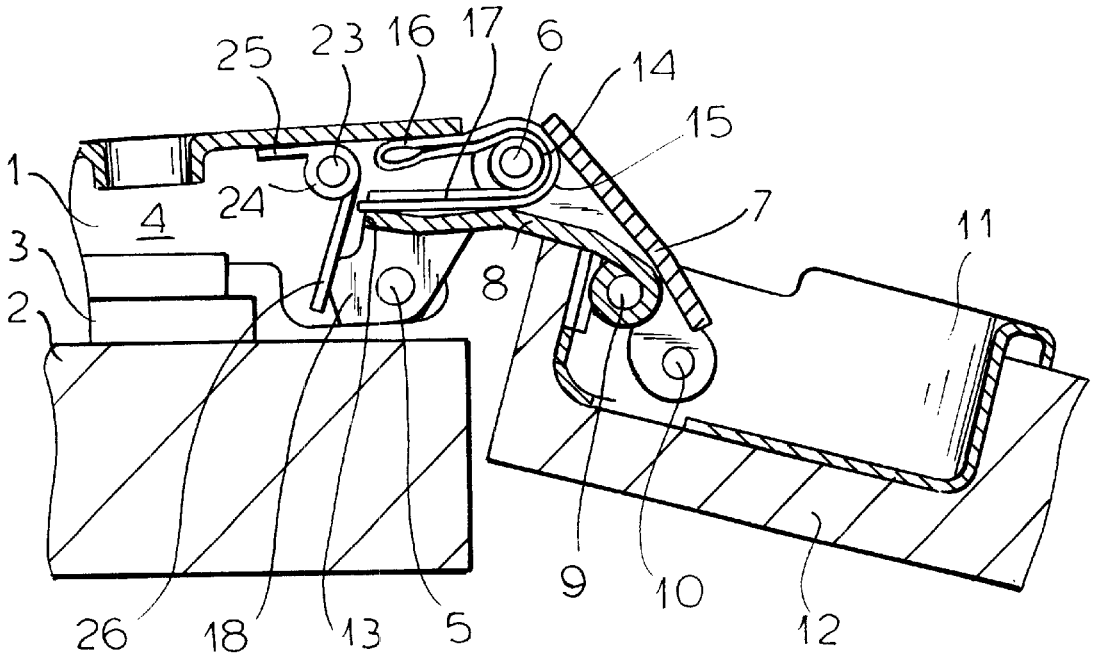
FIG. 1 is a longitudinal section of a hinge according to the invention in its open position, with arm fixed to the fixed portion of the piece of furniture and a mobile portion embedded in aa door.

The U-bent hinge arm 1, of which only the front side is illustrated, is connected in the usual manner to the body of the piece of furniture 2 through a fixing base 3. Pins 5, 6 are held between the sides 4 of the hinge arm 1. On these pins 5, 6, the first ends of equalizers or links 7, 8 are mounted in an oscillating manner. The other ends of equalizers 7, 8 are pivotable in an oscillating manner on pins 9, 10, arranged between the walls of the boxshaped oscillating member 11 embedded in a recess of door 12. Equalizer 7 consists of a U-bent plate portion whereas equalizer 8 consists of aa plate curled around pin 9 and U-bent at pin 5. A prolongation forming a projecting part 13 is realized on the back of equalizer 8, in the proximity of the articulation pin 5, so as to make equalizer 8 a two-arm lever.

Figure 2:
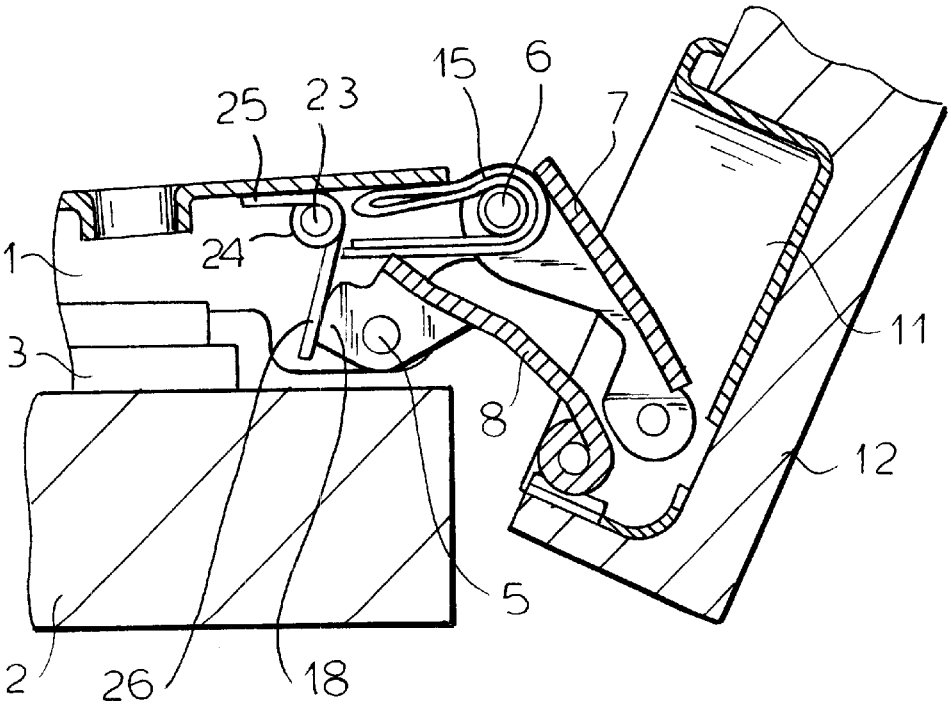
FIG. 2 is a longitudinal section of the open hinge of FIG. 1 in the position in which the braking effect starts.
Figure 3:
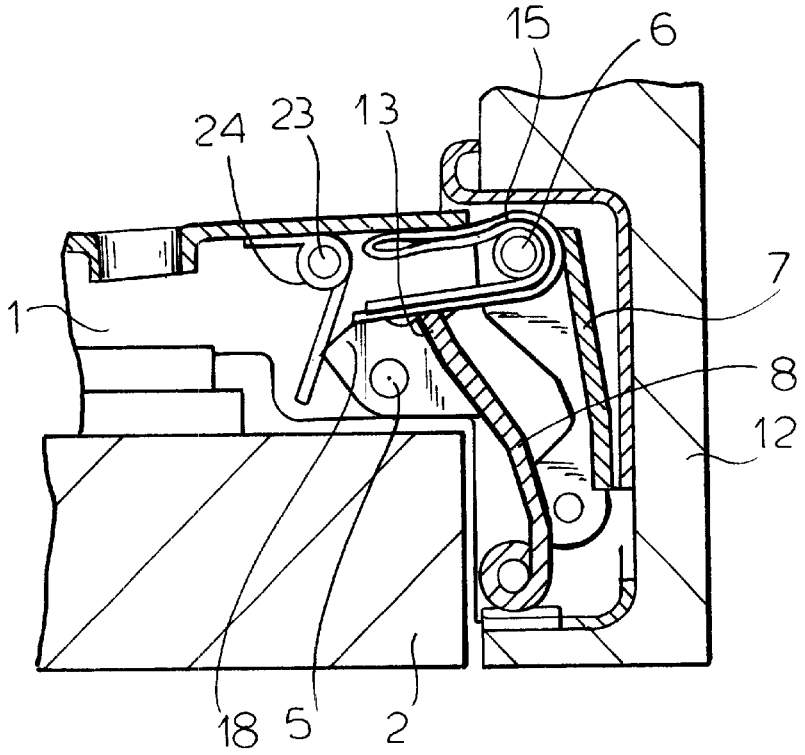
FIG. 3 shows a longitudinal section of the hinge FIGS. 1 and 2 in its closed position.

On the articulation pin 6 between the bent sides of equalizer 7 there is wound—with the interposition of a plastic bush 14—a lamination or leaf spring 15 with two arms 16, 17 of which one (16) abuts against the back of the hinge arm 1 and the other (17), capable of springing, pushes against an edge of the projecting part 13 of equalizer 8 in the manner shown in FIGS. 1 to 3, thus causing a thrust in the closing direction on the oscillating portion 11 of the hinge.

The hinge exhibits a known construction so far, thus a more detailed description is not provided.

Figure 4:
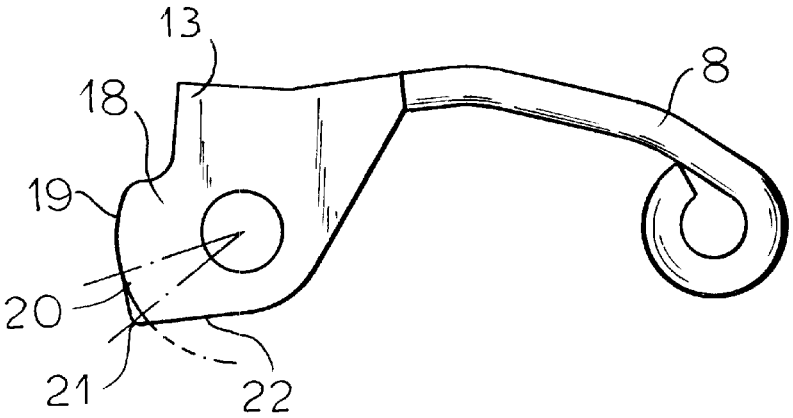
FIG. 4 is an enlarged side view of the equalizer provided with two projecting parts forming lever arms.

In the portion facing the piece of furniture interior, on the U-bent sides of equalizer 8 that is closer to the body of the piece of furniture 2, there is obtained a second projecting part 18 whose outside edge is exhibits a cam shape. In the portion that is closer to the back of the hinge arm 1, the cam 18—as can be better seen in FIG. 4—first forms a circumferential arc 19 that is concentric to the oscillation pin 5 of equalizer 8, which is followed by a portion 20 whose distance from the axis of pin 5 constantly increases, preferably according to a straight line, up to an edge 21 beyond which the distance rapidly decreases according to a straight line 22.

Between the sides of the hinge arm 1, in the portion above the projecting part 18 of equalizer 8 there is fixed a transversal pin 23 on which a torsion spring 24 is mounted, which is the second elastic contrast member. A shank 25 of spring 24 is fixed, and abuts against the back of the hinge arm 1, whereas the other shank 26 abuts against the cam-shaped projecting part 18 of equalizer 8.

Figure 6:
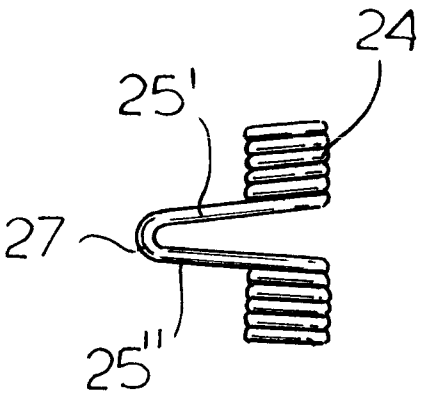
FIG. 6 shows a top view of the elastic contrast member.

The torsion spring 24 can have a symmetrical shape, as shown in FIG. 6, where the fixed shank 25 consists of two central shanks 25', 25", connected to one another by a light 27, and arms 26—that abut against the cams of the U-bent equalizer 8 are obtained at both sides.

In the open position of the hinge, that can be seen in FIG. 1, shank 26 of the torsion spring 24 abuts against the concentric portion 19 of cam 18, without exerting any moment on equalizer 8. Since spring 15 concurrently pushes the first projecting part 13 of equalizer 8 with a small lever arm with respect to the oscillation pin 5, which is not sufficient to overcome the existing friction forces, no thrust action is applied to the hinge.

In the position of the hinge close to the closure, as evident in FIG. 2, spring 15 exerts a moment on equalizer 8 that pushes door 12 towards its closed position. Shank 26 of the torsion spring 24 starts sliding on portion 20 with increasing distance of cam 18, thus exerting a moment on equalizer 8 that opposes the moment exerted by the first elastic member 15, thus decreasing its effect.

Figure 5:
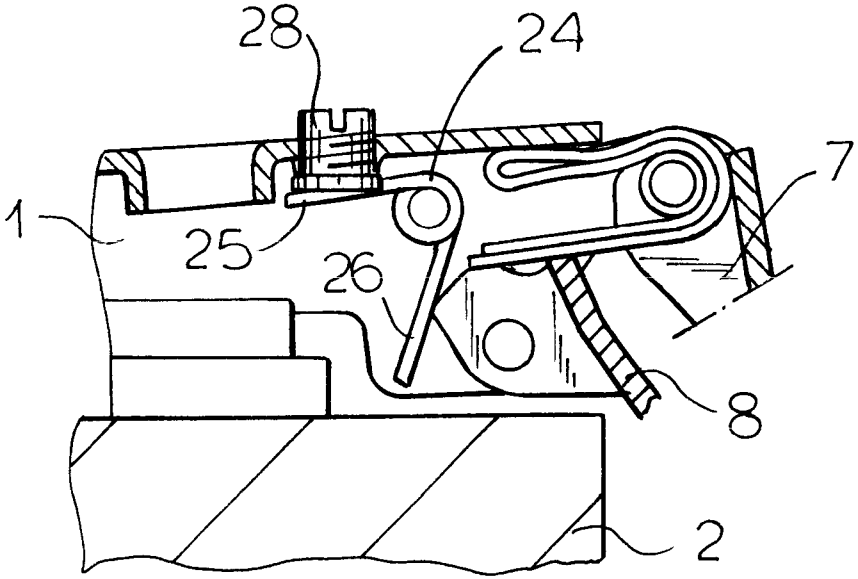
FIG. 5 is a partial longitudinal section corresponding to FIG. 3 of a second embodiment of the hinge.

In the closed position of the hinge, visible in FIG. 3, spring 15 still exerts a moment that keeps door 12 closed and arm 26 of the torsion spring 24 abuts against the initial portion of portion 22 of cam 18 just beyond edge 21, thus exerting a moment whose effect adds to that of the first elastic member 15. In the embodiment according to FIG. 5, there is provided a screw 28 screwed into the back of the hinge arm 1, against whose lower portion the fixed shank 25 of the torsion spring 24 abuts. By adjusting screw 28 it is therefore possible to adjust the pre-compression force and thus, the contrast force of spring 24.

What is claimed is:

1. A hinge for a piece of furniture comprising:

an arm fixable to a body of the piece of furniture; and a hinge portion connected to another part of the piece of furniture;

two equalizer links pivotally connected by transverse pins to said arm and to said portion forming respective pivot axis, one of said equalizer links having a projecting part at one pivot axis thereof forming a lever arm; and a first elastic member that stresses the projecting part of said one of said equalizer links so as to cause a thrust in the closing direction on said hinge portion; and a second elastic member acting upon a second projecting part of one of said equalizer links so as to exert a thrust that, for a movement of said portion close to a closed position thereof, counteracts a thrust exerted by the first elastic member.

2. The hinge according to claim 1 wherein the parts on which the two elastic members respectively act, are on the same equalizer link.

3. The hinge according to claim 2 wherein the second projecting part consists of a cam on U-bent sides of said one of said equalizer links, said cam comprising a first portion that is concentric to said one pivot axis, which in the closing direction of the hinge is followed by a portion at increasing distance from said one pivot axis up to an edge beyond which the distance from said one pivot axis rapidly decreases.

4. The hinge according to claim 3 wherein just before said huge portion reaches a closed position of the hinge, the second elastic member abuts against the decreasing distance portion just beyond a farthest edge from said one pivot axis.

5. The hinge according to claim 2 wherein said second elastic member consists of a torsion spring mounted on a transverse pin in said arm, with a fixed shank abutting against a back of said arm and another shank bearing on the cam of the equalizer.

6. The hinge according to claim 5 wherein the torsion spring has a symmetrical shape, with the fixed shank consisting of two central shanks connected to one another by a light and with two side shank that abut against the cam.

7. The hinge according to claim 5 wherein the fixed shank of the torsion spring abuts against the lower portion of a screw screwed in the back of the arm.

* * * * *